US009422811B2

(12) United States Patent
Bedouet et al.

(10) Patent No.: US 9,422,811 B2
(45) Date of Patent: Aug. 23, 2016

(54) PACKER TOOL INCLUDING MULTIPLE PORT CONFIGURATIONS

(71) Applicant: Schlumberger Technology Corporation, Sugar Land, TX (US)

(72) Inventors: Sylvain Bedouet, Houston, TX (US); Adriaan Gisolf, Houston, TX (US); Cosan Ayan, Istanbul (TR); Peter Hegeman, Stafford, TX (US); Ryan Sangjun Lee, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 61 days.

(21) Appl. No.: 14/135,835

(22) Filed: Dec. 20, 2013

(65) Prior Publication Data

US 2015/0176375 A1 Jun. 25, 2015

(51) Int. Cl.

| | |
|---|---|
| ***E21B 43/12*** | (2006.01) |
| ***E21B 33/127*** | (2006.01) |
| ***E21B 49/08*** | (2006.01) |
| ***E21B 33/12*** | (2006.01) |
| ***E21B 34/06*** | (2006.01) |

(52) U.S. Cl.

CPC ..... *E21B 49/081* (2013.01); *E21B 33/12* (2013.01); *E21B 34/06* (2013.01); *E21B 43/12* (2013.01)

(58) Field of Classification Search

CPC .... E21B 23/06; E21B 34/14; E21B 33/1295; E21B 43/045; E21B 33/124; E21B 33/127; E21B 49/10; E21B 33/12; E21B 33/1243

See application file for complete search history.

(56) References Cited

U.S. PATENT DOCUMENTS

| | | | |
|---|---|---|---|
| 2,747,401 | A | 5/1956 | Doll |
| 4,353,249 | A | 10/1982 | Lagus et al. |
| 4,742,459 | A | 5/1988 | Lasseter |
| 4,860,581 | A | 8/1989 | Zimmerman et al. |
| 4,936,139 | A | 6/1990 | Zimmerman et al. |
| 5,247,830 | A | 9/1993 | Goode |
| 5,269,180 | A | 12/1993 | Dave et al. |
| 5,279,153 | A | 1/1994 | Dussan, V et al. |
| 5,353,637 | A | 10/1994 | Plumb et al. |
| 5,517,584 | A | 5/1996 | Jennings |
| 5,663,559 | A | 9/1997 | Auzerais et al. |
| 6,092,416 | A | 7/2000 | Halford et al. |
| 6,675,892 | B2 | 1/2004 | Kuchuk et al. |
| 7,277,796 | B2 | 10/2007 | Kuchuk et al. |
| 7,445,043 | B2 | 11/2008 | Mullins et al. |

(Continued)

FOREIGN PATENT DOCUMENTS

| | | | |
|---|---|---|---|
| EP | 2128377 | A2 | 12/2009 |
| WO | 2009086279 | A2 | 7/2009 |

OTHER PUBLICATIONS

U.S. Appl. No. 13/923,220, filed Jun. 20, 2013.

(Continued)

*Primary Examiner* — Zakiya W Bates
(74) *Attorney, Agent, or Firm* — Kenneth L. Kincaid

(57) ABSTRACT

A tool is to be used within a wellbore including a wall and extending into a formation with formation fluid. The tool includes a packer expandable against the wellbore wall with ports included within the packer to enable formation fluid to flow into the tool from the formation. The ports are arranged in a first port configuration optimized based upon a first predetermined formation property.

17 Claims, 11 Drawing Sheets

(56) References Cited

U.S. PATENT DOCUMENTS

| | | | | |
|---|---|---|---|---|
| 7,647,980 | B2 | 1/2010 | Corre et al. | |
| 7,699,124 | B2 | 4/2010 | Corre et al. | |
| 7,913,557 | B2 | 3/2011 | Vasques et al. | |
| 7,944,211 | B2 | 5/2011 | Smits | |
| 8,078,403 | B2 | 12/2011 | Zhang et al. | |
| 8,091,634 | B2 | 1/2012 | Corre et al. | |
| 8,473,214 | B2 | 6/2013 | Gok et al. | |
| 2006/0248949 | A1 | 11/2006 | Gregory et al. | |
| 2010/0071898 | A1 | 3/2010 | Corre et al. | |
| 2010/0212891 | A1 | 8/2010 | Stewart et al. | |
| 2011/0139450 | A1 | 6/2011 | Vasques et al. | |
| 2014/0111347 | A1* | 4/2014 | Slapal et al. | 340/854.6 |

OTHER PUBLICATIONS

U.S. Appl. No. 13/750,923, filed Jan. 25, 2013.
U.S. Appl. No. 13/658,395, filed Oct. 23, 2013.
Al-Otaibi et al. "Oil-Water Delineation with a New Formation Tester Module," SPE 159641, SPE Annual Technical Conference and Exhibition, Oct. 8-10, 2012, San Antonio, Texas, pp. 1-13.
Flores de Dios et al. "New Wireline Formation Tester Development Makes Sampling and Pressure Testing Possible in Extra-Heavy Oil in Mexico," SPE 159868, SPE Annual Technical Conference and Exhibition, Oct. 8-10, 2012, San Antonio, Texas, pp. 1-9.
Search Report and Written Opinion issued in PCT application PCT/US2014/071061 on Apr. 8, 2015, 14 pages.

* cited by examiner

PACKER TOOL INCLUDING MULTIPLE PORT CONFIGURATIONS

BACKGROUND

A wellbore is generally drilled into the ground to recover natural deposits of hydrocarbons trapped in a geological formation below the Earth's crust. The wellbore is traditionally drilled to penetrate a subsurface hydrocarbon formation in the geological formation. As a result, the trapped hydrocarbons may be released and recovered from the wellbore.

A variety of packers are used in wellbores to isolate specific wellbore regions. A packer is delivered downhole on a conveyance and expanded against the surrounding wellbore wall to isolate a region of the wellbore. Often, two or more packers can be used to isolate one or more regions in a variety of well related applications, including production applications, service applications and testing applications.

In some applications, packers are used to isolate regions for collection of formation fluids. For example, a straddle packer can be used to isolate a specific region of the wellbore to allow collection of fluids. A straddle packer uses a dual packer configuration in which fluids are collected between two separate packers. The dual packer configuration, however, may be susceptible, such as to mechanical stresses, that may limit the expansion ratio and the drawdown pressure differential that can be employed.

SUMMARY

In an embodiment, the present disclosure may relate to a tool to be used within a wellbore including a wall and extending into a formation with formation fluid. The tool includes a packer expandable against the wellbore wall and ports included within the packer to enable formation fluid to flow into the tool from the formation. The ports are arranged in a first port configuration optimized based upon a first predetermined formation property.

In another embodiment, the present disclosure may relate to a method to collect fluid within a wellbore including a wall and extending into a formation with formation fluid. The method includes selecting a first port configuration for ports positioned on a packer optimized based upon a first predetermined formation property, expanding the packer against the wellbore wall, and receiving formation fluid from the formation into the tool through the ports.

In yet another embodiment, the present disclosure may relate to a packer to be used within a wellbore including a wall and extending into a formation with formation fluid. The packer includes ports having a sample port to sample formation fluid from the formation and a guard port to guard the sample port from contamination, the ports included within the packer to enable formation fluid to flow into the tool from the formation. Further, the ports are arranged in a first port configuration optimized based upon a first ratio of permeability for the formation in a first direction to permeability for the formation in a second direction.

BRIEF DESCRIPTION OF THE DRAWINGS

For a detailed description of the preferred embodiments of the invention, reference will now be made to the accompanying drawings in which.

Figure 5:
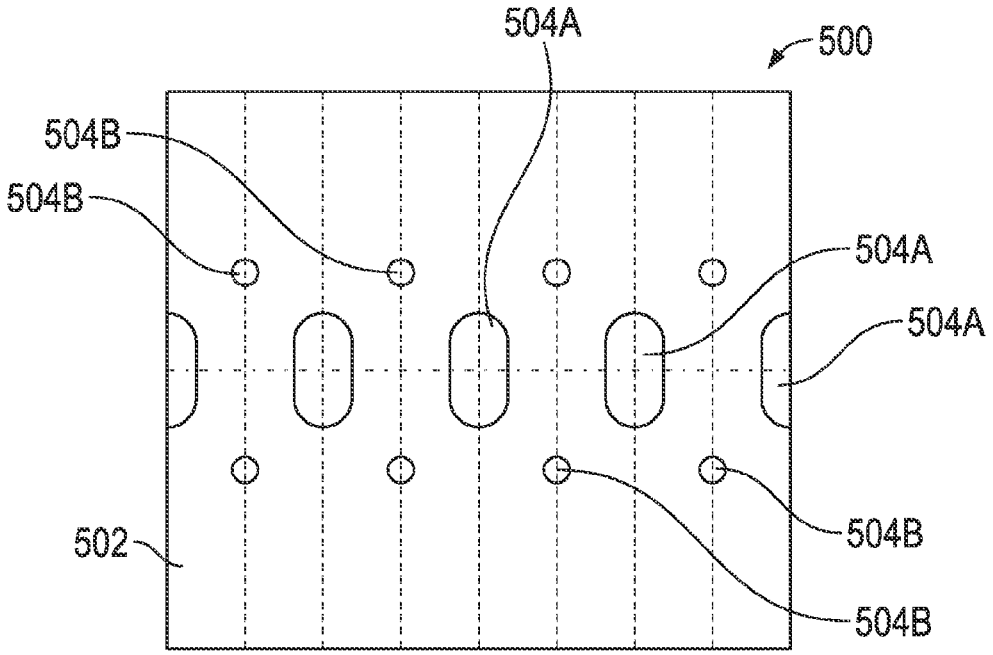
Figure 6:
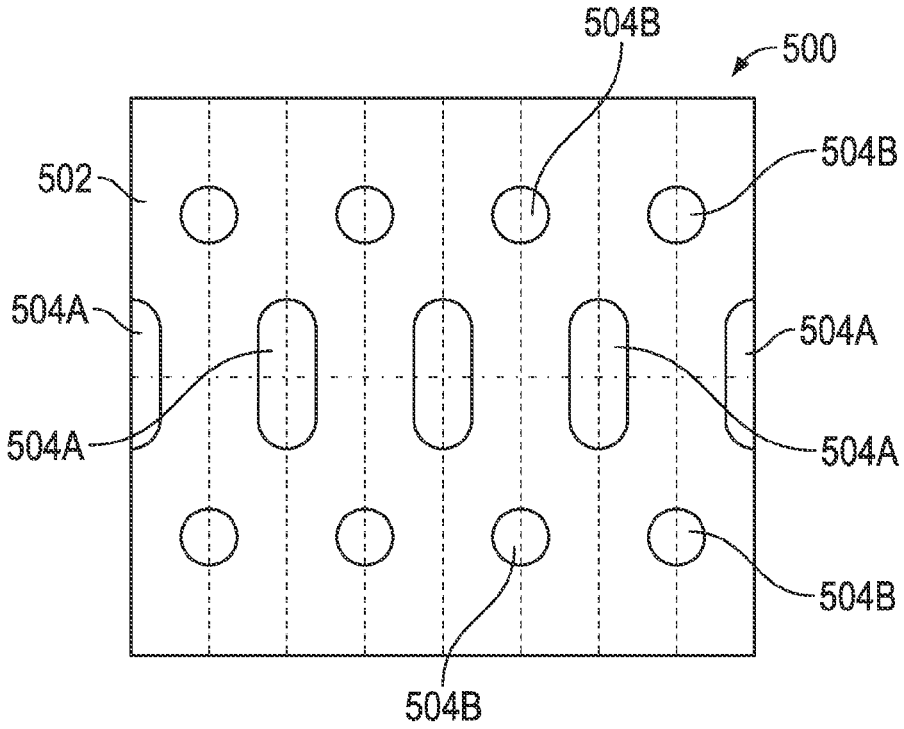
Figure 7:
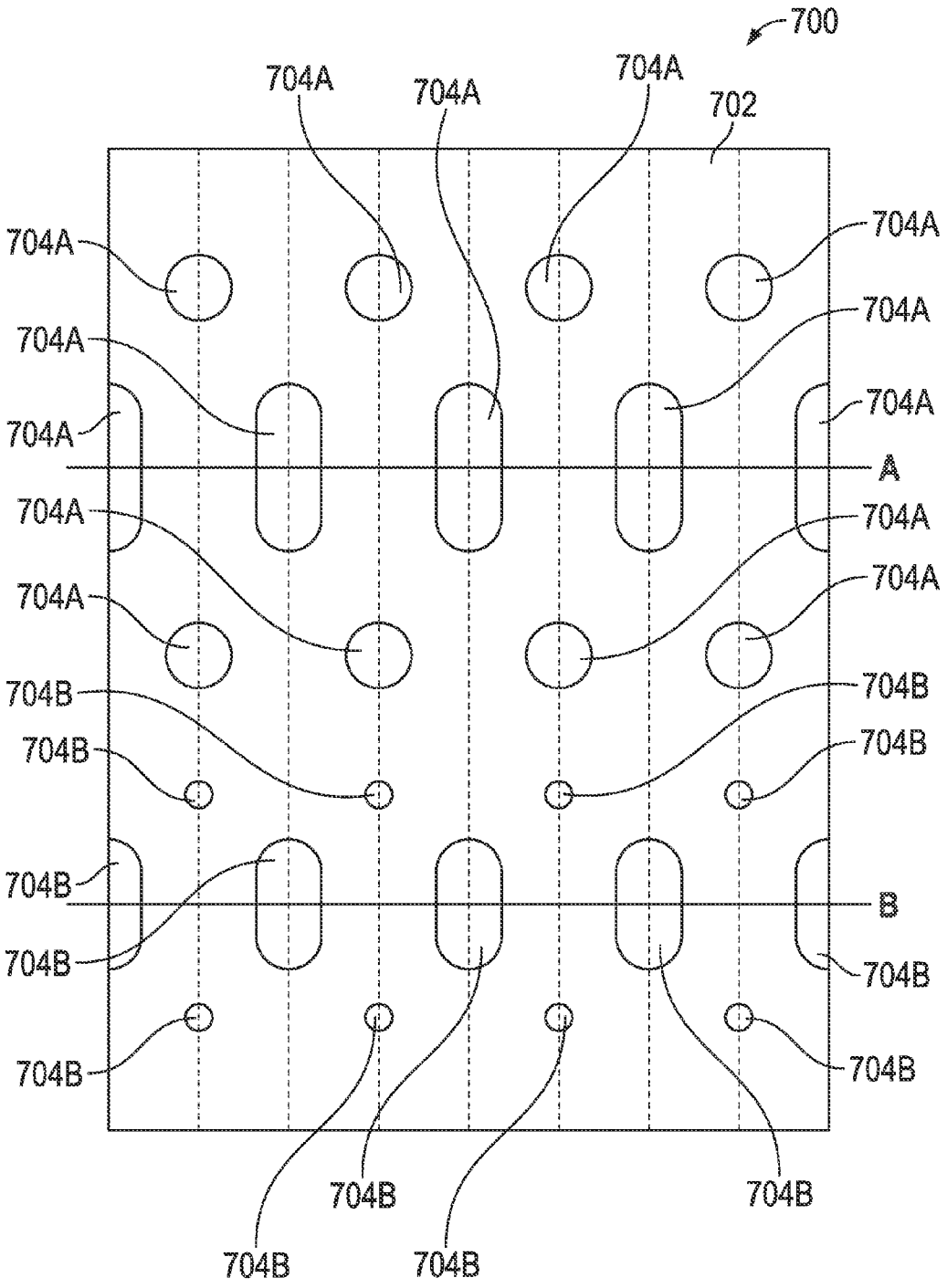
Figure 8:
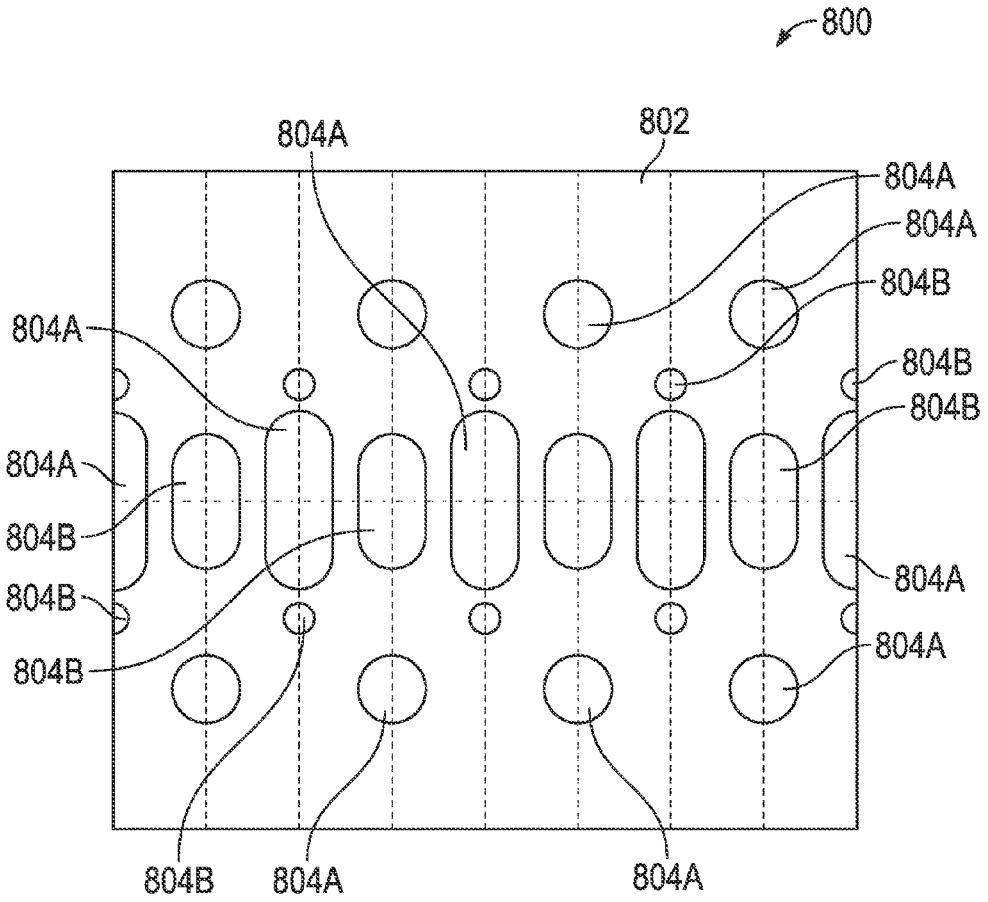
Figure 9:
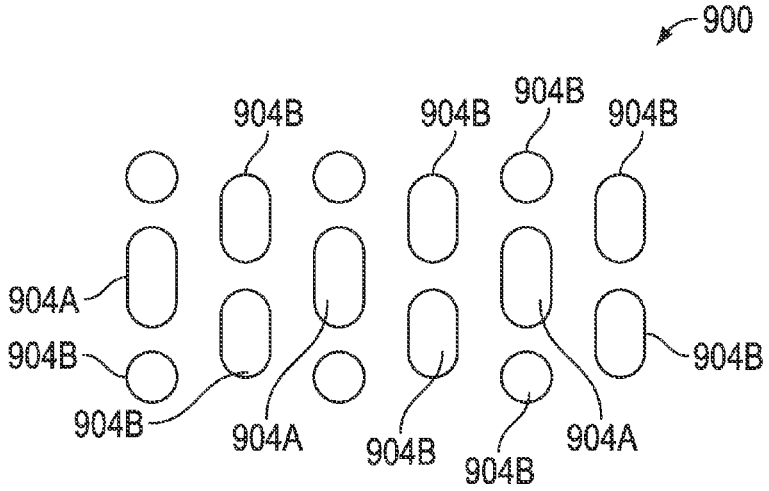
Figure 10:
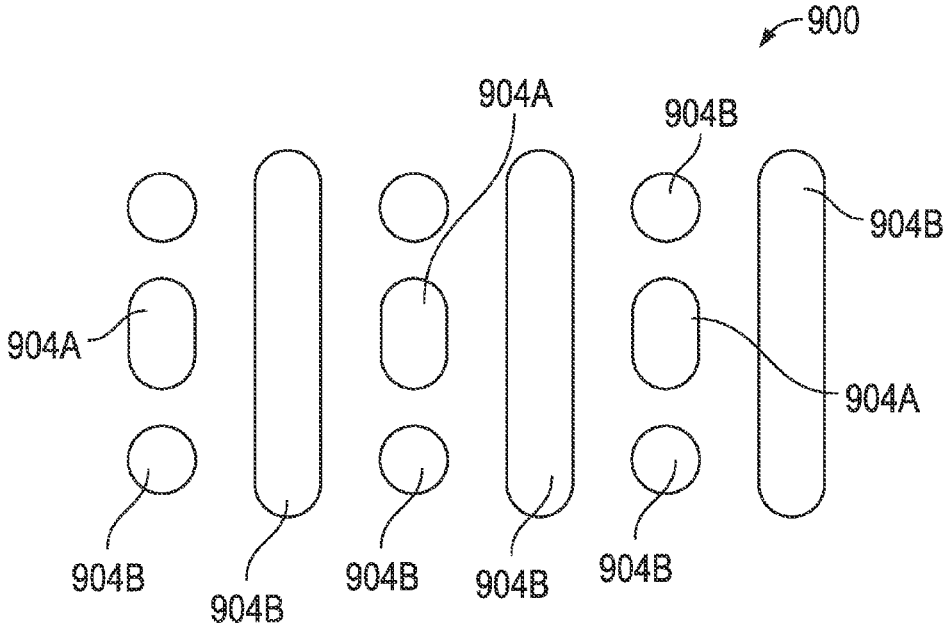
Figure 11:
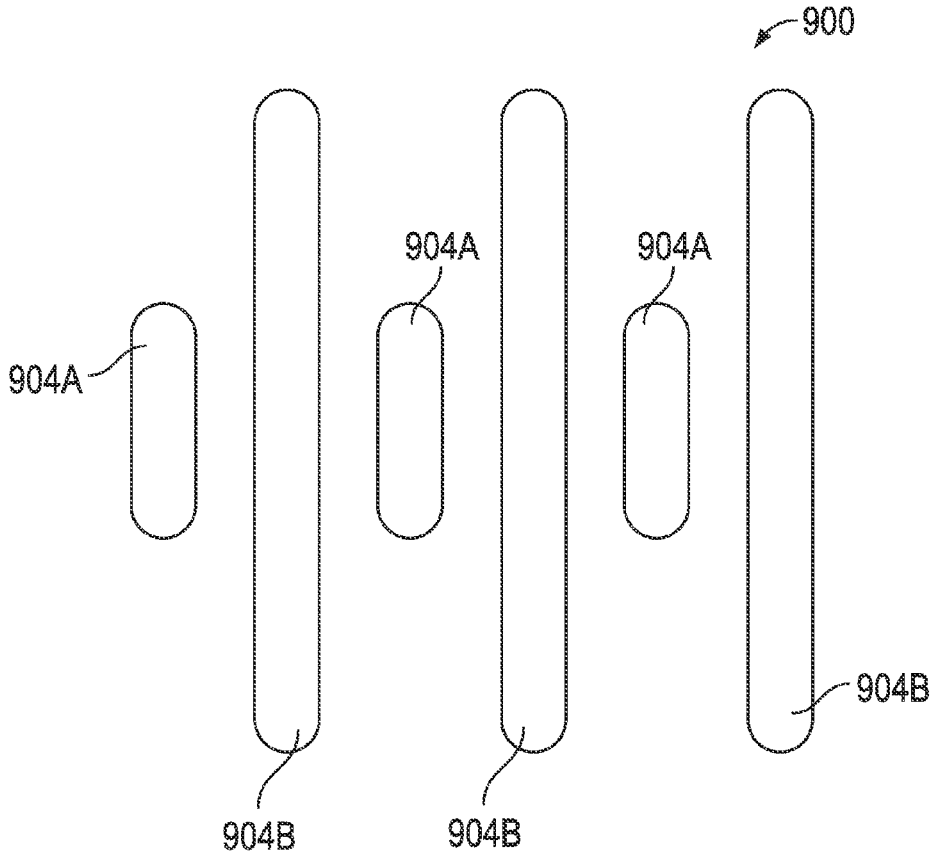
Figure 12:
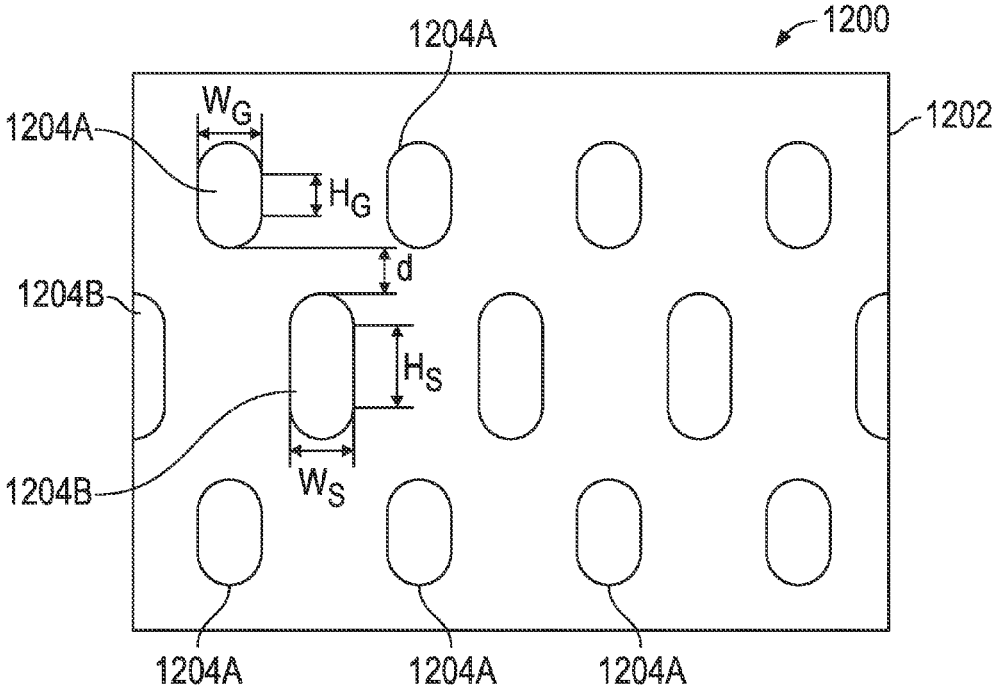
Figure 13:
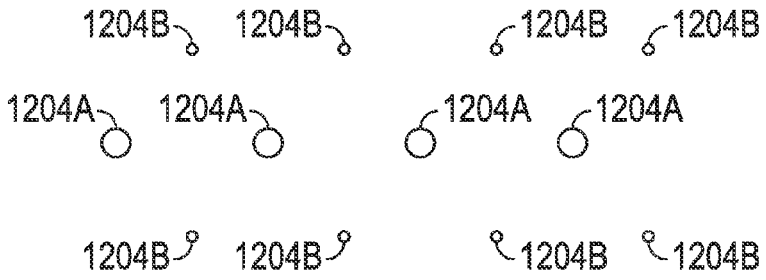
Figure 14:
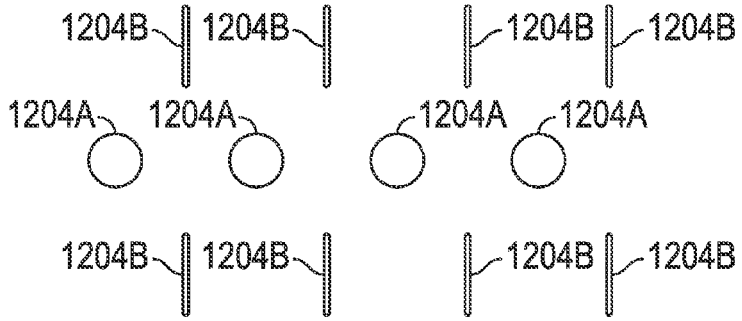
Figure 15:
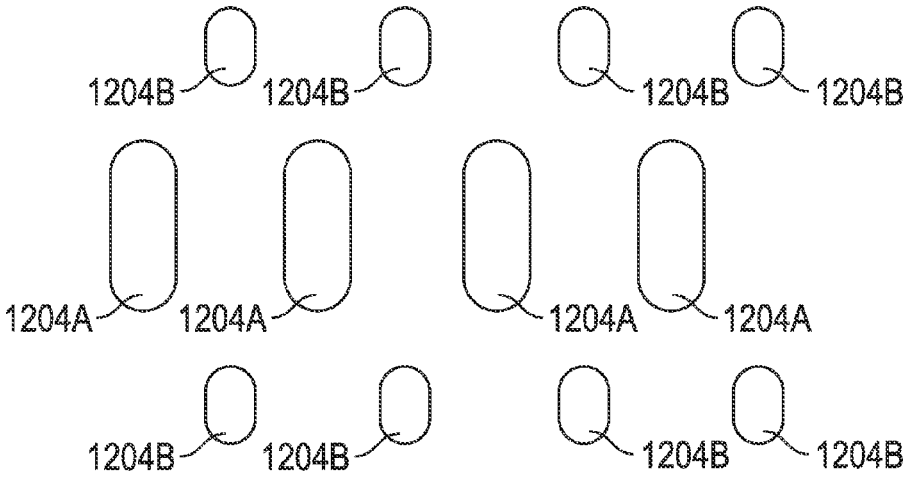
Figure 16:
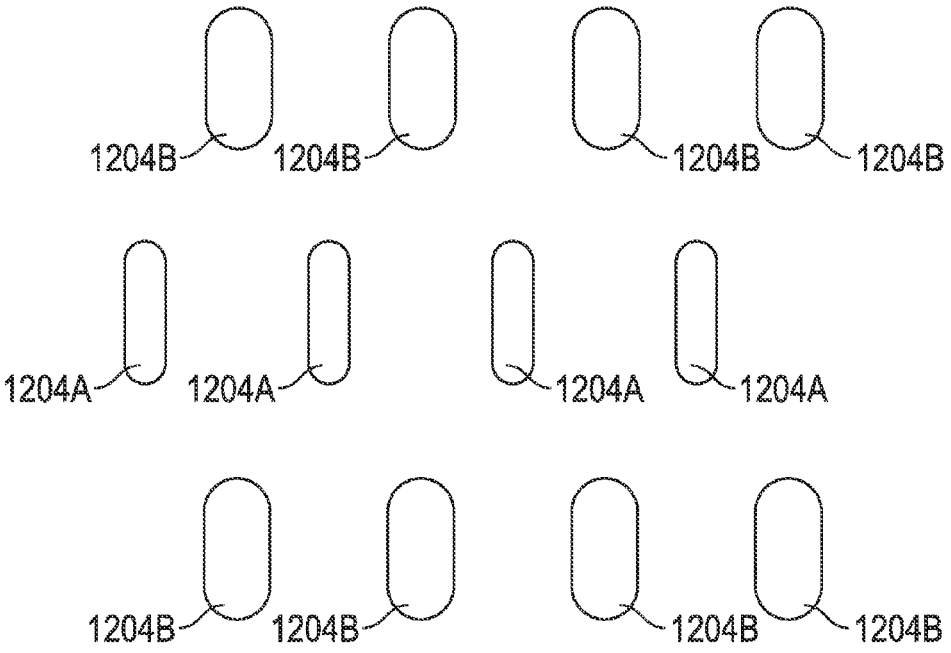
Figure 17:
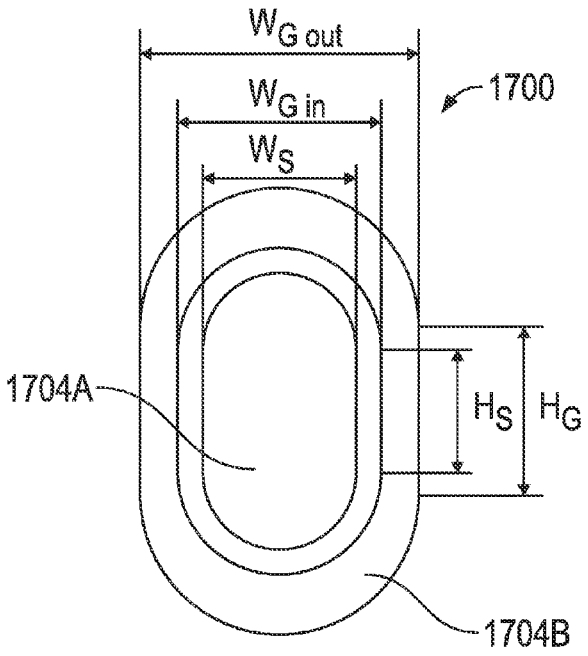
Figure 18:
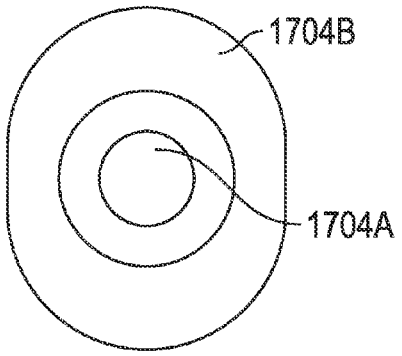
Figure 19:
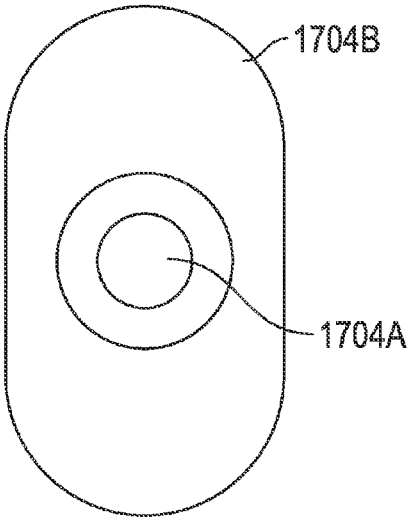
Figure 20:
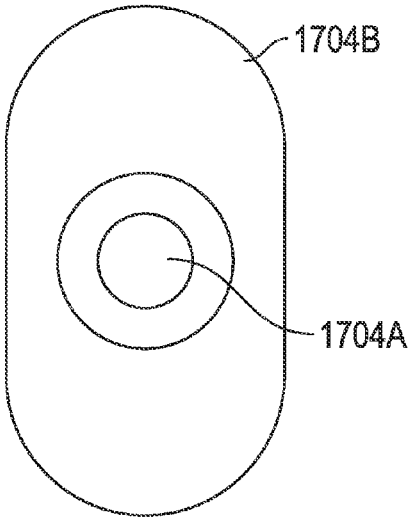
Figure 21:
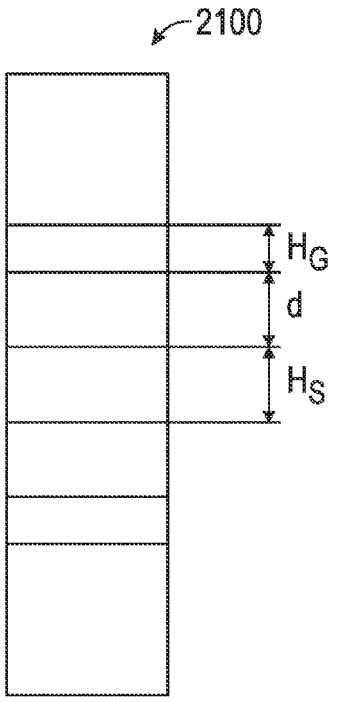
Figure 22:
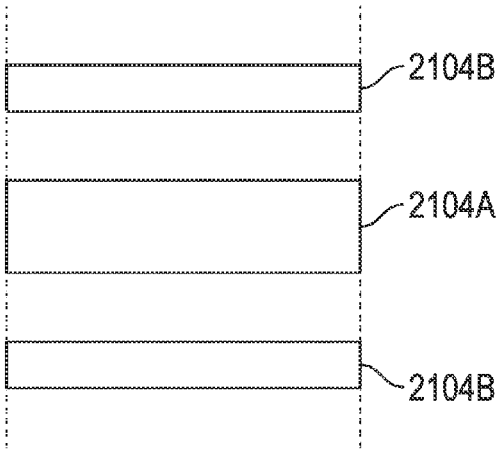
Figure 23:
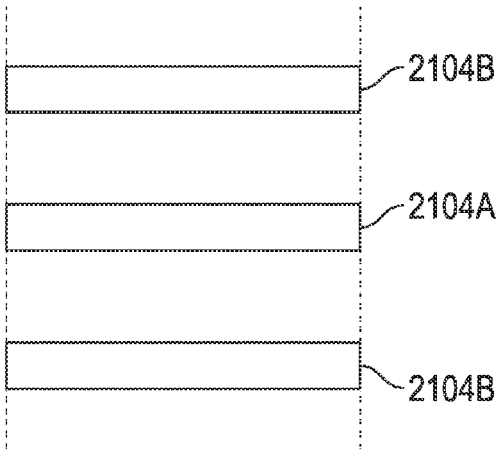
Figure 24:
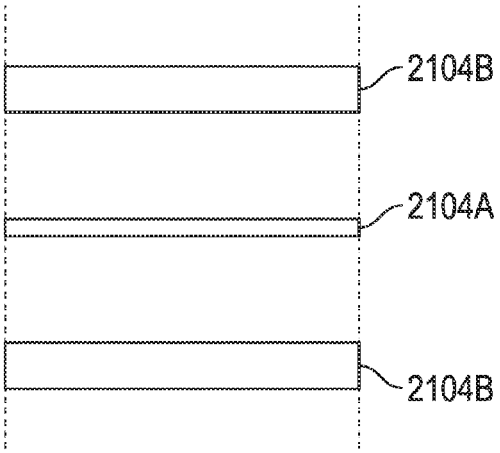
Figure 25:
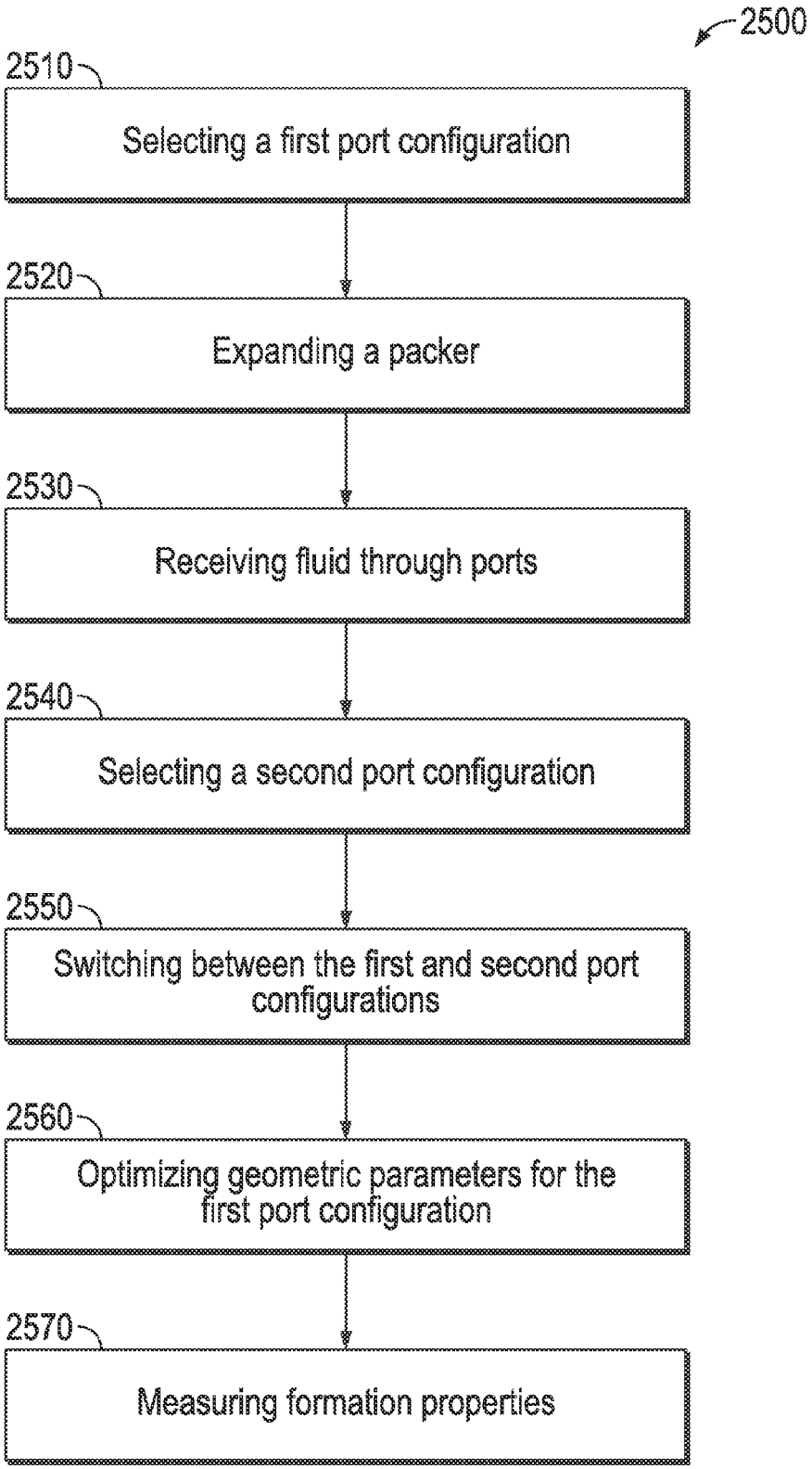

4 shows a cross-sectional view of a tool in accordance with one or more embodiments of the present disclosure;

FIG. 5 shows a view of a two-dimensional projection of a port configuration for a tool in accordance with one or more embodiments of the present disclosure;

FIG. 6 shows a view of a two-dimensional projection of a port configuration for a tool in accordance with one or more embodiments of the present disclosure;

FIG. 7 shows a view of a two-dimensional projection of a port configuration for a tool in accordance with one or more embodiments of the present disclosure;

FIG. 8 shows a view of a two-dimensional projection of a port configuration for a tool in accordance with one or more embodiments of the present disclosure;

FIG. 9 shows a view of a two-dimensional projection of a port configuration for a tool in accordance with one or more embodiments of the present disclosure;

FIG. 10 shows a view of a two-dimensional projection of a port configuration for a tool in accordance with one or more embodiments of the present disclosure;

FIG. 11 shows a view of a two-dimensional projection of a port configuration for a tool in accordance with one or more embodiments of the present disclosure;

FIG. 12 shows a view of a two-dimensional projection of a port configuration for a tool in accordance with one or more embodiments of the present disclosure;

FIG. 13 shows a view of a two-dimensional projection of a port configuration for a tool in accordance with one or more embodiments of the present disclosure;

FIG. 14 shows a view of a two-dimensional projection of a port configuration for a tool in accordance with one or more embodiments of the present disclosure;

FIG. 15 shows a view of a two-dimensional projection of a port configuration for a tool in accordance with one or more embodiments of the present disclosure;

FIG. 16 shows a view of a two-dimensional projection of a port configuration for a tool in accordance with one or more embodiments of the present disclosure;

FIG. 17 shows a view of a port configuration for a tool in accordance with one or more embodiments of the present disclosure;

FIG. 18 shows a view of a port configuration for a tool in accordance with one or more embodiments of the present disclosure;

FIG. 19 shows a view of a port configuration for a tool in accordance with one or more embodiments of the present disclosure;

FIG. 20 shows a view of a port configuration for a tool in accordance with one or more embodiments of the present disclosure;

FIG. 21 shows a view of a port configuration for a tool in accordance with one or more embodiments of the present disclosure;

FIG. 22 shows a view of a port configuration for a tool in accordance with one or more embodiments of the present disclosure;

FIG. 23 shows a view of a port configuration for a tool in accordance with one or more embodiments of the present disclosure;

FIG. 24 shows a view of a port configuration for a tool in accordance with one or more embodiments of the present disclosure; and FIG. 25 shows a flow chart of a method in accordance with one or more embodiments of the present disclosure.

DETAILED DESCRIPTION

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Accordingly, disclosed herein is a tool and packer for use within a wellbore, and/or a method to collect fluid within a wellbore. The tool includes a packer expandable against the wellbore wall and one or more ports included within the packer to enable formation fluid to flow into the packer from the formation. The ports include a port configuration that is optimized based upon a predetermined formation property, such as a ratio of permeability for the formation in a first direction to permeability for the formation in a second direction. In one or more embodiments, the port configuration may include a first port configuration and a second port configuration, in which the ports are switchable between the first port configuration and the second port configuration. The first port configuration may be optimized based upon a first predetermined formation property, and the second port configuration may be optimized based upon a second predetermined formation property. Further, in one or more embodiments, the ports may include a sample port and a guard port. Accordingly, one or more properties of the sample port, the guard port, and/or the interaction between the sample port and the guard port may be optimized based upon the predetermined formation property.

Figure 1:
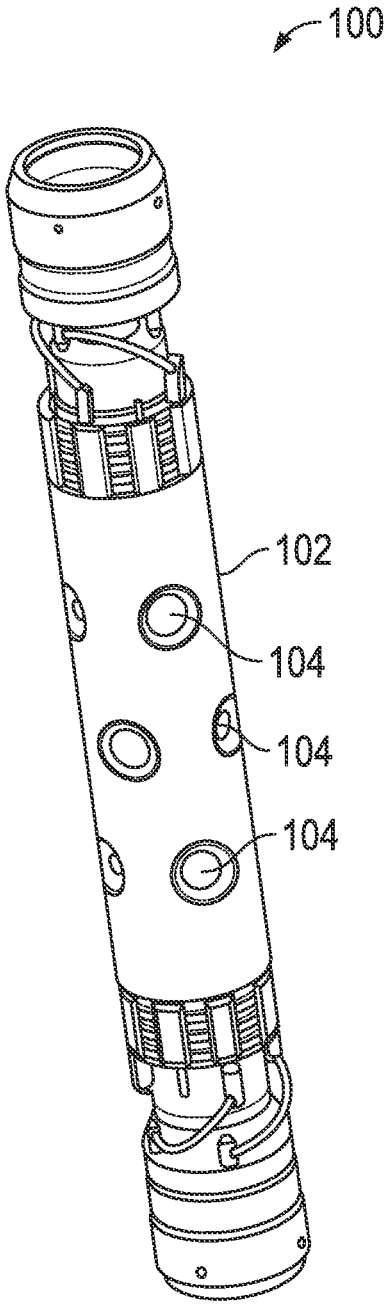
FIG. 1 shows a perspective view of a tool in accordance with one or more embodiments of the present disclosure.
Figure 2:
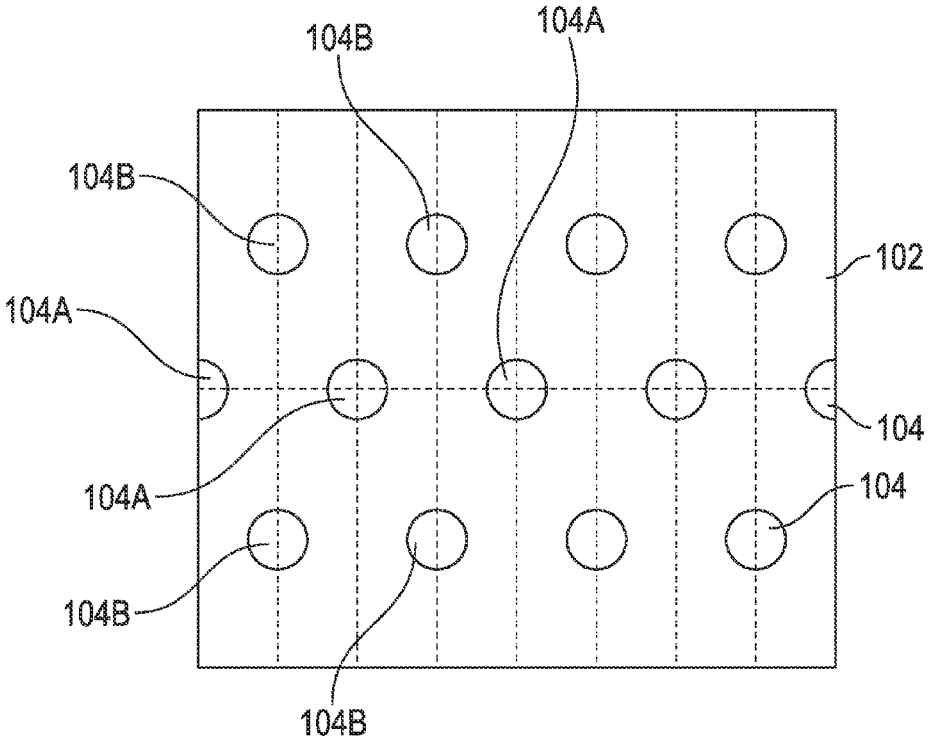
FIG. 2 shows a view of a two-dimensional projection of a port configuration for a tool in accordance with one or more embodiments of the present disclosure.

Referring now to FIGS. 1 and 2, multiple views of a tool 100 including a packer 102 in accordance with one or more embodiments of the present disclosure are shown. In particular, FIG. 1 shows a perspective view of the tool 100, and FIG. 2 shows a view of a two-dimensional projection of a port configuration for one or more ports 104 included on the packer 102 of the tool 100. The tool 100 may be used within a wellsite system, which may be located onshore or offshore, in which one or more of the present embodiments and methods for collecting one or more measurements, data, information and/or samples may be employed and/or practiced. For example, a wellbore or borehole (hereinafter "wellbore") may be drilled and/or formed within a subsurface, porous reservoir, or formation (hereinafter "formation") by one or more known drilling techniques. The wellbore may be drilled into or formed within the formation to recover and/or collect deposits of hydrocarbons, water, gases, such as, for example, non-hydrocarbon gases and/or other desirable materials trapped within the formation. The wellbore may be drilled or formed to penetrate the formation that may contain the trapped hydrocarbons, and/or other desirable materials, such as, for example, gases, water, carbon dioxide, and/or the like. As a result, the trapped hydrocarbons and/or other desirable materials may be released from the formation and/or may be recovered or collected via the wellbore.

Embodiments of the present systems and methods may be utilized during and/or after one or more vertical, horizontal and/or directional drilling operations or combinations thereof. As a result, the wellbore may be a vertical wellbore, a horizontal wellbore, an inclined wellbore, or may have any combination of vertical, horizontal, and inclined portions. The above-described wellsite system may be used as an example system in which the present disclosure may be incorporated and/or utilized, but a person having ordinary skill in the art will understand that the present disclosure may be utilized during and/or after any known drilling operation and/or downhole application, as known to one having ordinary skill in the art, such as, for example, logging, formation evaluation, drilling, sampling, formation testing, completions, flow assurance, production optimization, cementing and/or abandonment of the wellbore.

As shown, the tool 100 may include one or more packers 102, in which the packer 102 may be expandable such that the packer 102 may expand against and seal against a wall of a wellbore. For example, a packer in accordance with the present disclosure may include and/or be formed of a flexible and/or elastomeric material for squeezing, inflating, and/or otherwise expanding the packer.

The tool 100 may also include one or more ports 104 to enable fluid communication with the wellbore. In particular, the tool may include one or more ports 104 to enable formation fluid to flow into the packer 102 from the formation. As shown in FIG. 1, the first packer 102 may include one or more ports 104 positioned therein and/or formed therethrough, in which the ports 104 enable fluid flow between the tool 100 and the wellbore through the packer 102. For example, the packer 102, in addition to other packers shown and discussed within the present disclosure, may include an expandable element, such as a rubber layer, an inflatable layer, a rubber layer, and/or other similar elements. One or more of the ports 104 may be formed and/or positioned within the expandable element of the first packer 102, and/or one or more of the ports 104 may be surrounded, such as mostly surrounded, by the expandable element. When the first packer 102 then expands against the wall of the wellbore, the ports 104 may be positioned adjacent and/or partially embedded within the wall of the wellbore.

A tool in accordance with the present disclosure, and/or one or more components of the tool, may be adapted and/or configured to collect one or more measurements, data and/or samples (hereinafter "measurements") associated with and/or based on one or more characteristics and/or properties relating to the wellbore and/or the formation (collectively known hereinafter as "properties of the formation"). Accordingly, a tool of the present disclosure may include one or more sensors to collect and measure one or more characteristics and/or properties relating to the wellbore and/or the formation. In such an embodiment, one or more sensors may be positioned on one or more of the packers of the tool, and/or may be positioned within one or more intervals of the tool. For example, a sensor may be positioned adjacent one or more of the ports of the tool, such as positioned adjacent each port of the tool to measure one or more properties of the formation.

A tool in accordance with the present disclosure, and/or one or more components thereof, may be and/or may include, for example, one or more downhole tools and/or devices that may be lowered and/or run into the wellbore. For example, the tool 100 may be a downhole formation testing tool that may be used to conduct, execute, and/or complete one or more downhole tests, such as, for example, a local production test, a buildup test, a drawdown test, an injection test, an interference test, and/or the like. The interference test may include, for example, an interval pressure transient test (hereinafter "IPTT test") and/or a vertical interference test. It should be understood that the one or more downhole tests that may be conducted by the tool 100 or components thereof may be any downhole tests as known to one of ordinary skill in the art.

A tool in accordance with the present disclosure, and/or one or more components thereof, may be conveyed into the wellbore by any known conveyance, such as drill pipe, tubular members, coiled tubing, wireline, slickline, cable, or any other type of conveyance. For example, in one or more embodiments, the tool 100 may be conveyed into the wellbore via a wireline cable. As a result, a tool of the present disclosure may be positionable and/or locatable within the wellbore and/or adjacent to one or more wellbore walls (hereinafter "walls") of the wellbore. In one or more embodiments, a tool of the present disclosure may be configurable to collect one or more measurements relating to the wellbore, the formation, and/or the walls of the wellbore. For example, the tool 100 may be used to collect pressure data and/or measurements relating to the wellbore and the formation. The tool 100 may be, for example, a formation testing tool configured to collect the pressure data and/or measurements relating to the wellbore and the formation. The tool 100 may be connected to and/or incorporated into, for example, a drill string, a test string, or a tool string.

In embodiments, a tool in accordance with the present disclosure, and/or one or more components thereof, may be connected to and/or incorporated into, for example, a modular formation dynamic tester (hereinafter "MDT") test string. The drill string, test string, or tool string may include one or more additional downhole components (hereinafter "additional components"), such as, for example, drill pipe, one or more drill collars, a mud motor, a drill bit, a telemetry module, an additional downhole tool, and/or one or more downhole sensors. It should be understood that the drill string, test string, or tool string may include any number of and/or any type of additional downhole components as known to one of ordinary skill in the art.

As shown particularly in FIG. 2, the ports 104 of the tool 100 may include one or more sample ports 104A and one or more guard ports 104B. For example, the guard ports 104B may be positioned adjacent or in the vicinity of the sample ports 104A to reduce or prevent contamination from being introduced into a sample collected by the tool 100. In FIG. 2, the guard ports 104B may be positioned above and/or below the sample ports 104A such that contaminate may be collected by and through the guard ports 104B for a cleaner sample to be collected by and through the sample ports 104A. In particular, the guard ports 104B may be opened first to enable formation fluid to flow therethrough to collect contaminate and filtrate, with the sample ports 104A then opened after the guard ports 104B such that the formation fluid collected through the sample ports 104A includes less contaminate and filtrate. In FIG. 2, the ports 104 are shown in an individual port configuration, with the ports 104 individually formed and spaced from other ports 104. Further, the ports 104 are shown in a staggered configuration with the sample ports 104A staggered and offset in alignment from the guard ports 104B.

As a tool is used within a wellbore extending into a formation to perform various functions, such as receiving from and/or expelling fluid into the formation when in the wellbore, the tool may be optimized based upon one or more properties of the wellbore and formation. For example, a port configuration for the one or more ports of the tool may be optimized based upon a predetermined formation property. In one embodiment, a property of the formation may be determined, in which a port configuration optimized for the determined property formation may then be selected for use within a packer of a tool in accordance with the present disclosure. In such an embodiment, the property of the formation may be determined and measured by a tool in accordance with the present disclosure, such as when in use downhole with a wellbore, in which the optimized port configuration for the formation property may then be selected for use, or continued for use, while downhole. In another embodiment, the property of the formation may be determined and measured using other tools and/or methods, in which these formation properties may be used when selecting an optimized port configuration. Accordingly, the port configuration of the ports may be optimized based upon permeability anisotropy of the formation.

"Anisotropy" may refer to a variation of a property with the direction in which the property is measured. Rock permeability is a measure of the conductivity to fluid flow through the pore spaces of the rock. Formation and reservoir rocks often exhibit permeability anisotropy whereby conductivity to fluid depends on the direction of flow of the formation fluid. For example, when comparing permeability measured parallel or substantially parallel to the formation bed boundaries, which may be referred to as horizontal permeability, $k_h$, and permeability measured perpendicular or substantially perpendicular to the formation bed boundaries, which may be referred to as vertical permeability, $k_v$. Such permeability anisotropy is referred to as two-dimensional (hereinafter "2D") anisotropy.

Further, a formation may exhibit anisotropy within the plane parallel or substantially parallel to the formation bed boundaries, such that instead of a single value of horizontal permeability, $k_h$, separate components may be measured in orthogonal or substantially orthogonal directions, such as, for example x- and y-directions, referred to as $k_x$ and $k_y$, respectively. A formation that exhibits variation in permeability when measured vertically or substantially vertically, as well as, both horizontally or substantially horizontal directions may be referred to as three-dimensional (hereinafter "3D") anisotropy. Rock that exhibits no directional variation in permeability is referred to as "isotropic."

One or more tools, such as the tool 100 shown above, in addition to other tools, such as formation testing tools, may be used to determine 2D and/or 3D permeability anisotropy, such as through an IPTT test. For example, during an IPTT test, a tool may be used to pump formation fluid from the formation into the wellbore. From the transient reservoir pressure response, 2D and/or 3D permeability anisotropy may be measured, estimated, and/or otherwise determined. Such tests can be performed with a single probe, multi probe, dual-packer, single packer, packer-packer combinations, and/or packer-probe combinations.

In one or more embodiments, such as when sampling, a tool may be used to obtain a fluid sample containing relatively low amounts of contamination, such as drilling fluid contamination, with the sample collected at a pressure above the saturation pressure of the fluid in a relatively short amount of time. As discussed above, a focusing effect for a tool in accordance with the present disclosure may be achieved by pumping and pulling mud filtrate from above or below the tool into guard ports, focusing clean or low contamination formation fluid to the sample ports. The efficiency of the sampling can vary significantly according to formation properties, such as a formation permeability anisotropic ratio and viscosity contrast between mud filtrate and formation fluid. Accordingly, in one or more embodiments, a port configuration may be optimized based upon a predetermined formation property, such as to minimize clean-up time, the time necessary for a tool and/or a packer to obtain and collect a fluid sample that limits fluid contamination at a pressure above the saturation pressure for the fluid.

A port configuration for a tool in accordance with the present disclosure may be optimized, such as when sampling, based upon the operating conditions and formation properties when in use within a wellbore. For example, one or more geometric parameters of the sample ports and/or the guard ports may be changed to optimize the performance of the tool when used within a wellbore. In one embodiment, the port configuration for the ports of the tool may be optimized based upon a ratio or comparison of the permeability for the formation in a first direction with respect to the permeability for the formation in a second direction, such as 2D permeability anisotropy and/or 3D permeability anisotropy. Other properties of the formation that may vary the geometry and configuration for the ports may include the comparison of the viscosity of the drilling fluid filtrate with respect to the formation fluid, the formation thickness, the depth of invasion within the formation, the allowable pressure draw down for the formation fluid (e.g. due to saturation pressure), and/or one or more other properties of the formation. Accordingly, one or more tests may be conducted to estimate and determine one or more of the above properties, such as 2D permeability anisotropy, 3D permeability anisotropy, fluid viscosity, formation thickness, and/or depth of invasion.

One or more examples of embodiments that may incorporate a tool or a method including an optimized port configuration may include: selectively opening and/or closing ports positioned within a packer; selectively changing the shape and/or size of a port; selectively moving a position of a port on the surface of a packer; selectively directing one or more ports to be in fluid communication with a sample flow path and/or a guard flow path, thereby selectively enabling one or more ports to be a sample port and/or a guard port; selectively connecting to either smaller or larger ports, such as sample ports or guard ports, that may be at a similar vertical alignment; and/or other port parameters and configurations that may be varied and optimized.

Figure 3:
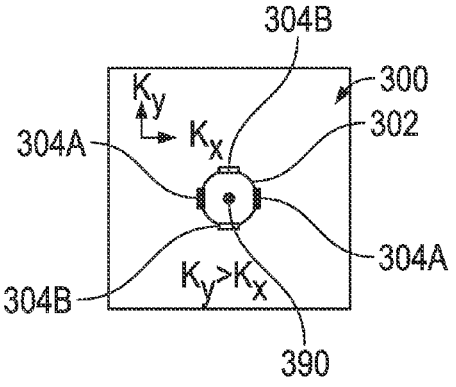
FIG. 3 shows a cross-sectional view of a tool in accordance with one or more embodiments of the present disclosure.
Figure 4:
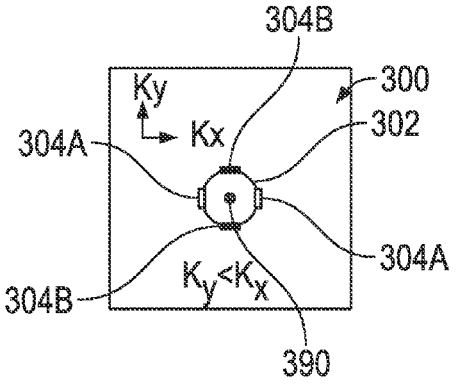

Referring now to FIGS. 3 and 4, multiple cross-sectional views of a tool 300 in accordance with one or more embodiments of the present disclosure are shown. The tool 300 may include an axis 390, such as extending through the tool 300. The tool 300 may include a packer 302, with one or more ports 304 positioned on and/or formed through the packer 302. The ports 304 may include one or more sample ports and/or one or more guard ports and enable fluid flow between the tool 300 and the wellbore through the packer 302.

Accordingly, FIG. 3 shows the tool 300 with the ports 304 in a first port configuration optimized for a first predetermined formation property, and FIG. 4 shows the tool 300 with the ports 304 in a second port configuration optimized for a second predetermined formation property. In this embodiment, the ports 304 may be switchable between the first port configuration and the second port configuration. For example, one or more of the ports 304 of the tool 300 may be selectively opened and/or closed based upon the predetermined formation properties to optimize the port configuration of the ports 304.

In accordance with one or more embodiments of the present disclosure, the ports 304, as shown in FIGS. 3 and 4, may include a first set of ports 304A and a second set of ports 304B. In this embodiment, the first set of ports 304A may have a first circumferential position on the packer 302 with respect to the axis 390, and the second set of ports 304B may have a second circumferential position on the packer 302 with respect to the axis 390 that is different from the first circumferential position for the first set of ports 304A. In FIGS. 3 and 4, as the x- and y-directions are shown, referred to as $k_x$ and $k_y$, respectively, the first set of ports 304A may have the first circumferential position such that the first set of ports 304A is oriented and/or face in the x-direction. In such an embodiment, fluid flowing through the first set of ports 304A into and/or out of the tool 300 would flow in the x-direction in FIGS. 3 and 4. Further, the second set of ports 304B may have the second circumferential position such that the second set of ports 304B is oriented and/or face in the y-direction. In such an embodiment, fluid flowing through the second set of ports 304B into and/or out of the tool 300 would flow in the y-direction in FIGS. 3 and 4.

Accordingly, based upon one or more predetermined formation properties, the tool 300 may switch between a first port configuration with the first set of ports 304A and a second port configuration with the second set of ports 304B. In FIGS. 3 and 4, the predetermined formation property may indicate that the formation may exhibit anisotropy within the plane parallel or substantially parallel to the formation bed boundaries. Accordingly, with respect to FIG. 3, in an embodiment in which the predetermined formation property shows that the permeability of the formation is greater in the y-direction, referred to as $k_y$, than the x-direction, referred to as $k_x$, then the ports 304 of the tool 300 in the y-direction may be opened to enable fluid flow therethrough while the ports 304 in the x-direction may be closed to prevent fluid flow therethrough. For example, for the first port configuration in FIG. 3, the second set of ports 304B may be opened to enable formation fluid to flow into the packer 302 from the formation, while the first set of ports 304A may be closed to prevent formation fluid to flow into the packer 302 from the formation.

With respect to FIG. 4, in an embodiment in which the predetermined formation property shows that the permeability of the formation is greater in the x-direction, referred to as $k_x$, than the y-direction, referred to as $k_y$, then the ports 304 of the tool 300 in the x-direction may be opened to enable fluid flow therethrough while the ports 304 in the y-direction may be closed to prevent fluid flow therethrough. For example, for the second port configuration in FIG. 4, the first set of ports 304A may be opened to enable formation fluid to flow into the packer 302 from the formation, while the second set of ports 304B may be closed to prevent formation fluid to flow into the packer 302 from the formation.

Accordingly, with respect to FIGS. 3 and 4, the ports 304 may have a port configuration such that the ports 304 oriented in the direction with higher or the highest permeability may enable fluid flow therethrough while the ports 304 oriented in the direction with lower or the lowest permeability may prevent fluid flow therethrough, thereby focusing the sampling for the tool 300 in a direction with higher permeability. In one or more embodiments, one or more ports 304 in the direction with higher or the highest permeability may enable more fluid flow therethrough, such as by increasing the size of such ports 304, while the ports 304 oriented in the direction with lower or the lowest permeability may prevent, restrict, or otherwise reduce fluid flow therethrough, such as by decreasing the size of such ports 304, thereby focusing the sampling for the tool 300 in a direction with higher permeability. Further, in one or more embodiments, one or more ports 304 in the direction with higher or the highest permeability may be used as sample ports, such as to collect fluid samples, while the ports 304 oriented in the direction with lower or the lowest permeability may be used as guard ports, such as to guard the sample ports from fluid contamination, thereby focusing the sampling for the tool 300 in a direction with higher permeability.

Referring now to FIGS. 5 and 6, multiple two-dimensional projections of port configurations for one or more ports 504 included on a packer 502 of a tool 500 in accordance with one or more embodiments of the present disclosure are shown. The ports 504 may include one or more sample ports 504A and/or one or more guard ports 504B and enable fluid flow between the tool 500 and the wellbore through the packer 502. For example, in FIGS. 5 and 6, the sample ports 504A may be positioned centrally within the port configuration with the guard ports 504B positioned above and/or below the sample ports 504A.

Accordingly, FIG. 5 shows the tool 500 with the ports 504 in a first port configuration optimized for a first predetermined formation property, and FIG. 6 shows the tool 500 with the ports 504 in a second port configuration optimized for a second predetermined formation property. In particular, FIG. 5 shows the first port configuration of the ports 504 optimized for a first formation permeability anisotropic ratio, and FIG. 6 shows the second port configuration of the ports 504 optimized for a second formation permeability anisotropic ratio.

In FIG. 5, the port configuration is optimized for a relatively lower ratio of permeability for the formation measured in a direction perpendicular or substantially perpendicular to the formation bed boundaries, which may be referred to as vertical permeability, $k_v$, to permeability for the formation measured in a direction parallel or substantially parallel to the formation bed boundaries, which may be referred to as horizontal permeability, $k_h$. Further, in FIG. 6, the port configuration is optimized for a relatively higher ratio of vertical permeability, $k_v$, to horizontal permeability, $k_h$. Thus, in accordance with one or more embodiments of the present disclosure, as vertical permeability increases with respect to horizontal permeability, one or more of the following may occur: the sample ports 504A may increase in height; the distance between the sample ports 504A and the guard ports 504B may increase; the guard ports 504B may increase in height; and/or the guard ports 504B may increase in width. Accordingly, as vertical permeability increases with respect to horizontal permeability, the ports 504 may have one or more features optimized to increase the size of the ports and/or the overall port configuration footprint in the vertical direction with respect to the horizontal direction.

Referring now to FIG. 7, a two-dimensional projection of multiple port configurations with one or more ports 704 included on a packer 702 of a tool 700 in accordance with one or more embodiments of the present disclosure are shown. The ports 704 may include one or more sample ports and/or one or more guard ports and enable fluid flow between the tool 700 and the wellbore through the packer 702.

Accordingly, FIG. 7 shows the tool 700 with the ports 704 in a first port configuration optimized for a first predetermined formation property and in a second port configuration optimized for a second predetermined formation property. In this embodiment, the ports 704 may be switchable between the first port configuration and the second port configuration. For example, one or more of the ports 704 of the tool 700 may be selectively opened and/or closed based upon the predetermined formation properties to optimize the port configuration of the ports 704.

In accordance with one or more embodiments of the present disclosure, the ports 704, as shown in FIG. 7, may include a first set of ports 704A and a second set of ports 704B. In this embodiment, the first set of ports 704A may have a first port configuration at a first axial position on the packer 702 with respect to an axis of the tool 700, and the second set of ports 704B may have a second port configuration at a second axial position on the packer 702 with respect to the axis of the tool 700 that is different from the first axial position for the first set of ports 704A. For example, in FIG. 7, the first set of ports 704A of the first port configuration may have the first axial position such that the first set of ports 704A is oriented, centered, and/or aligned about an axial position A, and the second set of ports 704B of the second port configuration may have the first axial position such that the first set of ports 704A is oriented, centered, and/or aligned about an axial position B.

Accordingly, based upon one or more predetermined formation properties, the tool 700 may switch between the first port configuration with the first set of ports 704A and the second port configuration with the second set of ports 704B. In this embodiment, the first port configuration for the first set of ports 704A may be similar to the port configuration shown in FIG. 6, and the second port configuration for the second set of ports 704B may be similar to the port configuration shown in FIG. 5.

Accordingly, in an embodiment in which the predetermined formation property shows a relatively higher ratio of vertical permeability, $k_v$, to horizontal permeability, $k_h$, the first port configuration may be used, in which the first set of ports 704A having the axial position A may be positioned within a wellbore to be axially aligned with a zone-of-interest within the formation. In an embodiment in which the predetermined formation property shows a relatively lower ratio of vertical permeability, $k_v$, to horizontal permeability, $k_h$, the second port configuration may be used, in which the second set of ports 704B having the axial position B may be positioned within a wellbore to be axially aligned with a zone-of-interest within the formation. Thus, the tool 700 may then switch between the first port configuration with the first set of ports 704A and the second port configuration with the second set of ports 704B based upon one or more predetermined formation properties.

Referring now to FIG. 8, a two-dimensional projection of multiple port configurations with one or more ports 804 included on a packer 802 of a tool 800 in accordance with one or more embodiments of the present disclosure are shown. The ports 804 may include one or more sample ports and/or one or more guard ports and enable fluid flow between the tool 800 and the wellbore through the packer 802.

Accordingly, FIG. 8 shows the tool 800 with the ports 804 in a first port configuration optimized for a first predetermined formation property and in a second port configuration optimized for a second predetermined formation property. In this embodiment, the ports 804 may be switchable between the first port configuration and the second port configuration. The ports 804 may include a first set of ports 804A and a second set of ports 804B, in which the first set of ports 804A may have a first port configuration and the second set of ports 804B may have a second port configuration. However, in this embodiment, the first port configuration with the first set of ports 804A may have the same axial position on the packer 802 as the second port configuration with the second set of ports 804B such that the first port configuration may axially overlap, at least partially, with the second port configuration.

In this embodiment, the first port configuration for the first set of ports 804A may be similar to the port configuration shown in FIG. 6, and the second port configuration for the second set of ports 804B may be similar to the port configuration shown in FIG. 5. Accordingly, in an embodiment in which the predetermined formation property shows a relatively higher ratio of vertical permeability, $k_v$, to horizontal permeability, $k_h$, the first port configuration may be used, thereby enabling fluid flow through the first set of ports 804A while preventing fluid flow through the second set of ports 804B. In an embodiment in which the predetermined formation property shows a relatively lower ratio of vertical permeability, $k_v$, to horizontal permeability, $k_h$, the second port configuration may be used, thereby enabling fluid flow through the second set of ports 804B while preventing fluid flow through the first set of ports 804A.

Referring now to FIGS. 9-11, multiple two-dimensional projections of port configurations with one or more ports 904 included on a packer of a tool 900 in accordance with one or more embodiments of the present disclosure are shown. The ports 904 may include one or more sample ports 904A and/or one or more guard ports 904B and enable fluid flow between the tool 900 and the wellbore through the packer.

With respect to one or more of the above embodiments, the sample ports and the guard ports may be arranged with respect to each other such that the guard ports may be positioned above and/or below an axial position of one or more sample ports. For example, with respect to FIG. 2, the guard ports 104B may be positioned axially above and/or axially below the sample ports 104A, such as with respect to an axis of the packer 102 and the tool 100. However, as shown in FIGS. 9-11, the guard ports 904B and the sample ports 904A may have the same axial position and/or the axial positions of the guard ports 904B and the sample ports 904A may overlap.

Further, with respect to one or more of the above embodiments, the sample ports and the guard ports may be arranged with respect to each other such that the guard ports may be positioned to the side, such as to the right and/or the left, of a circumferential position of one or more sample ports. For example, with respect to FIG. 2, the guard ports 104B may be positioned to the right and/or to the left of the sample ports 104A, such as with respect to an axis of the packer 102 and the tool 100. However, as shown in FIGS. 9-11, the guard ports 904B and the sample ports 904A may have the same circumferential position and/or the circumferential positions of the guard ports 904B and the sample ports 904A may overlap.

Accordingly, as shown in FIGS. 9 and 10, the port configuration may include sample ports 904A and guard ports 904B, in which the sample ports 904A may have one or more guard ports 904B surrounding the sample ports 904A. In such an embodiment, the port configuration may include one or more guard ports 904B with the same or overlapping circumferential positions as the sample ports 904A. Further, the port configuration may include one or more guard ports 904B with the same or overlapping axial positions as the sample ports 904A. Thus, the sample ports 904A may have both vertical guarding and horizontal guarding from the guard ports 904B. Further, as shown in FIG. 11, the port configuration may include one or more guard ports 904B with the same or overlapping circumferential positions as the sample ports 904A. Such port configurations may enable the guard ports 904B to decrease the time necessary for sampling clean-up as vertical permeability increases with respect to horizontal permeability within a formation.

Referring now to FIGS. 12-16, multiple two-dimensional projections of port configurations with one or more ports 1204 included on a packer of a tool 1200 in accordance with one or more embodiments of the present disclosure are shown. The ports 1204 may include one or more sample ports 1204A and/or one or more guard ports 1204B and enable fluid flow between the tool 1200 and the wellbore through the packer. Further, FIGS. 12-16 show a port configuration that may include an individual port configuration, in which each of the ports 1204 may be individually formed and spaced from other ports 1204 within the port configuration.

FIG. 12 shows a port configuration with one or more defined geometric parameters. In accordance with one or more embodiments of the present disclosure, one or more of the defined geometric parameters for the port configuration may be optimized and adjusted based upon a predetermined formation property. The geometric parameters for the ports 1204 of the port configuration may include one or more of the following: a width of a sample port, $W_S$; a height of a sample port, $H_S$; a width of a guard port, $W_G$; a height of a guard port, $H_G$; and a distance (e.g., vertical distance) between the sample port and the guard port, d.

Accordingly, as one or more predetermined formation properties may change and adjust, one or more parameters for the port configuration of a packer for a tool used within the formation may be optimized for the changing predetermined formation properties. FIGS. 13-16 show optimized port configurations for the ports 1204 of the tool 1200 as the ratio of vertical permeability, $k_v$, to horizontal permeability, $k_h$, for a formation increases. As vertical permeability, $k_v$, increases with respect to horizontal permeability, $k_h$, the port configuration may be optimized such that the guard ports 1204B may provide more vertical guarding for the sample ports 1204A. Accordingly, as vertical permeability, $k_v$, increases with respect to horizontal permeability, $k_h$, one or more of the following geometric parameters for the port configuration may be optimized: the width of one or more sample ports 1204A, $W_S$, may increase; the height of one or more sample ports 1204A, $H_S$, may increase; the width of one or more guard ports 1204B, $W_G$, may increase; the height of one or more guard ports, $H_G$, may increase; the distance (e.g., vertical distance) between one or more sample ports 1204A and one or more guard ports 1204B, d, may increase; and a ratio of an area of one or more guard ports 1204B to the area of one or more sample ports 1204A may increase.

Referring now to FIGS. 17-20, multiple two-dimensional projections of port configurations with one or more ports 1704 included on a packer of a tool 1700 in accordance with one or more embodiments of the present disclosure are shown. The ports 1704 may include one or more sample ports 1704A and/or one or more guard ports 1704B and enable fluid flow between the tool 1700 and the wellbore through the packer. Further, FIGS. 17-20 show a port configuration that may include an enclosed port configuration and/or a concentric port configuration, in which the sample ports 1704A may be enclosed and surrounded by the guard ports 1704B.

FIG. 17 shows a port configuration with one or more defined geometric parameters. The geometric parameters for the ports 1704 of the port configuration may include one or more of the following: a width of a sample port, $W_S$; a height of a sample port, $H_S$; an inner width of a guard port, $W_{Gin}$; an outer width of a guard port, $W_{Gout}$; and a height of a guard port, $H_G$.

Accordingly, as one or more predetermined formation properties may change and adjust, one or more parameters for the port configuration of a packer for a tool used within the formation may be optimized for the changing predetermined formation properties. FIGS. 17-20 show optimized port configurations for the ports 1704 of the tool 1700 as the ratio of vertical permeability, $k_v$, to horizontal permeability, $k_h$, for a formation increases. As vertical permeability, $k_v$, increases with respect to horizontal permeability, $k_h$, the port configuration may be optimized such that the guard ports 1704B may provide more vertical guarding for the sample ports 1704A. Accordingly, as vertical permeability, $k_v$, increases with respect to horizontal permeability, $k_h$, one or more of the following geometric parameters for the port configuration may be optimized: the inner width of one or more guard ports 1704B, $W_{Gin}$, may increase; the outer width of one or more guard ports 1704B, $W_{Gout}$, may increase; the height of one or more guard ports, $H_G$, may increase; and a ratio of an area of one or more guard ports 1704B to the area of one or more sample ports 1704A may increase.

Referring now to FIGS. 21-24, multiple views of port configurations with one or more ports 2104 included on a packer of a tool 2100 in accordance with one or more embodiments of the present disclosure are shown. The ports 2104 may include one or more sample ports 2104A and/or one or more guard ports 2104B and enable fluid flow between the tool 2100 and the wellbore through the packer. Further, FIGS. 21-24 show a port configuration that may include a ring port configuration, in which one or more of the ports 2104 may extend substantially about the packer of the tool 2100.

FIG. 21 shows a port configuration with one or more defined geometric parameters. The geometric parameters for the ports 2104 of the port configuration may include one or more of the following: a height of a sample port, $H_S$; a height of a guard port, $H_G$; and a distance (e.g., vertical distance) between the sample port and the guard port, d.

Accordingly, as one or more predetermined formation properties may change and adjust, one or more parameters for the port configuration of a packer for a tool used within the formation may be optimized for the changing predetermined formation properties. FIGS. 21-24 show optimized port configurations for the ports 2104 of the tool 2100 as the ratio of vertical permeability, $k_v$, to horizontal permeability, $k_h$, for a formation increases. As vertical permeability, $k_v$, increases with respect to horizontal permeability, $k_h$, the port configuration may be optimized such that the guard ports 2104B may provide more vertical guarding for the sample ports 2104A. Accordingly, as vertical permeability, $k_v$, increases with respect to horizontal permeability, $k_h$, one or more of the following geometric parameters for the port configuration may be optimized: the height of one or more sample ports 2104A, $H_S$, may increase; the height of one or more guard ports, $H_G$, may increase; the distance (e.g., vertical distance) between one or more sample ports 2104A and one or more guard ports 2104B, d, may increase; and a ratio of an area of one or more guard ports 2104B to the area of one or more sample ports 2104A may increase.

A tool in accordance with one or more embodiments of the present disclosure may include one or more flow paths formed therein and/or extending therethrough. For example, a tool in accordance with the present disclosure may include one or more sample ports flow paths and one or more guard port flow paths. In such an embodiment, the sample ports may be in fluid communication with the sample port flow path of the tool such that fluid received through the sample ports may be received and flow into the sample port flow path. Further, the guard ports may be in fluid communication with the guard port flow path of the tool such that fluid received through the guard ports may be received and flow into the guard port flow path. This configuration may enable fluid that is received into the sample ports to be fluidly isolated from the guard ports, such as to prevent contamination for the fluid received within the sample ports.

Further, a tool in accordance with the present disclosure may include one or more valves, one or more gauges, and/or one or more sensors. For example, a tool in accordance with the present disclosure may include one or more valves operably coupled to one or more ports, one or more port configurations, one or more sets of ports, and/or one or more flow paths. In an embodiment in which a tool includes multiple sets of ports in multiple port configurations, a valve may be operably coupled to one or more sets of ports in a different port configuration. In such an embodiment, and with reference to FIG. 7, a first sample port valve may be operably coupled to the sample ports 704A of the first port configuration, a first guard port valve may be operably coupled to the guard ports 704A of the first port configuration, a second sample port valve may be operably coupled to the sample ports 704B of the second port configuration, and/or a second guard port valve may be operably coupled to the guard ports 704A of the second port configuration. Accordingly, one or more of the valves may be selectively opened or closed to enable or prevent fluid flow through one or more of the ports.

Referring now to FIG. 25, a flow chart of a method 2500 to collect fluid within a wellbore in accordance with one or more embodiments of the present disclosure is shown. The method 2500 may include selecting a first port configuration 2510, in which a first port configuration may be selected for the ports positioned on a packer and is optimized based upon a first predetermined formation property. For example, one or more predetermined formation properties may be used when optimizing the configuration of ports on the packer, and such port configurations may be selected for the ports on a packer of a tool when such predetermined formation properties are expected to be encountered within a wellbore.

One or more predetermined formation properties that a port configuration may be optimized for may include a ratio or comparison of the permeability for the formation in a first direction with respect to the permeability for the formation in a second direction, such as 2D permeability anisotropy and/or 3D permeability anisotropy, the comparison of the viscosity of the drilling fluid filtrate with respect to the formation fluid, the formation thickness, the depth of invasion within the formation, the allowable pressure draw down for the formation fluid (e.g. due to saturation pressure), and/or one or more other properties of the formation. Accordingly, in one or more embodiments, a property of the formation may be determined, in which a port configuration optimized for the determined property formation may then be selected for use within a packer of a tool in accordance with the present disclosure. In such an embodiment, the property of the formation may be determined and measured by a tool in accordance with the present disclosure, such as when in use downhole with a wellbore, in which the optimized port configuration for the formation property may then be selected for use, or continued for use, while downhole. In another embodiment, the property of the formation may be determined and measured using other tools and/or methods, in which these formation properties may be used when selecting an optimized port configuration, such as when on the surface before positioning a tool with an optimized port configuration within the wellbore.

The method 2500 may then include expanding the packer 2520 and receiving fluid through the ports 2530, in which the packer may be expanded against the wellbore wall to receive formation fluid from the formation into the tool through the ports. The method 2500 may further include selecting a second port configuration 2540 and switching between the first and second port configurations 2550. For example, a second port configuration may be selected for the ports positioned on the packer that is optimized based upon a second predetermined formation property. The predetermined formation property may include a ratio or comparison of the permeability for the formation in a first direction with respect to the permeability for the formation in a second direction, such as 2D permeability anisotropy and/or 3D permeability anisotropy, the comparison of the viscosity of the drilling fluid filtrate with respect to the formation fluid, the formation thickness, the depth of invasion within the formation, the allowable pressure draw down for the formation fluid (e.g. due to saturation pressure), and/or one or more other properties of the formation. According to certain embodiments, the second predetermined formation property may be determined based on measurements, such as pretest pressure measurements, resistivity measurements, and/or permeability measurements, made while the tool is positioned within the wellbore.

In an embodiment in which the packer includes a first port configuration and a second port configuration, the packer may switch between the first and second port configurations, such as by selectively opening and closing one or more ports on the packer. In another embodiment, packers having different port configurations, such as a first packer having a first port configuration and a second packer having a second port configuration may be switched between, such as based upon the predetermined formation properties expected to be encountered within a wellbore. In certain embodiments, the first port configuration may be selected based on predetermined formation properties obtained while the tool is located at the surface, for example properties determined using historical well data, while the second port configuration may be selected based on predetermined formation properties obtained while the tool is positioned within the wellbore.

Further, the method 2500 may include optimizing geometric parameters for the first port configuration 2560. Accordingly, selecting a first port configuration 2510 may include optimizing geometric parameters for the first port configuration, such as by optimizing the distance between one or more ports of the packer, optimizing the heights and/or widths of one or more ports, and/or optimizing a ratio of the areas between one or more ports. Furthermore, the method 2500 may include measuring formation properties 2570. For example, a tool in accordance with the present disclosure may be used to measure permeability in one or more directions of a formation, in which the first port configuration for the ports is then optimized for the measured permeabilities and/or other properties.

A tool in accordance with the present disclosure may have an optimized port configuration to obtain a fluid sample containing relatively low amounts of contamination, such as drilling fluid contamination, with the sample collected at a pressure above the saturation pressure of the fluid in a relatively short amount of time. As discussed above, a focusing effect for a tool in accordance with the present disclosure may be achieved by pumping and pulling mud filtrate from above or below the tool into guard ports, focusing clean or low contamination formation fluid to the sample ports. The efficiency of the sampling can vary significantly according to formation properties, such as a formation permeability anisotropic ratio and viscosity contrast between mud filtrate and formation fluid. Accordingly, in one or more embodiments, a port configuration may be optimized based upon a predetermined formation property, such as to minimize clean-up time, the time necessary for a tool and/or a packer to obtain and collect a fluid sample that limits fluid contamination at a pressure above the saturation pressure for the fluid.

A port configuration may be optimized based upon other one or more other objectives, such as in addition or in alternative to minimizing clean-up time. For example, a port configuration may be optimized to capture a larger sample port volume, in which the tool may then have a larger rate to receive fluid through the sample port(s) as compared to the guard port(s), and thus may also have a larger area for the sample port(s) as compared to the guard port(s). In another embodiment, the tool may be used to characterize the formation fluid using one or more sensors and gauges on the tool, as compared to collecting a fluid sample. The tool may then have a smaller rate to receive fluid through the sample port(s) as compared to the guard port(s), and thus may also have a smaller area for the sample port(s) as compared to the guard port(s).

Further, a tool in accordance with the present disclosure may enable focused sampling. As the ports may be in fluid communication with multiple flow paths, fluid may be received through one or more ports to receive filtrate therein, whereas fluid may be received through other ports to receive sample fluid. For example, a port may be used on a packer to receive sample fluid therein, in which adjacent ports, such as ports of the intervals and/or ports of the packers, may be used as guard ports to receive filtrate therein that may be undesirable for sampling.

Furthermore, a tool in accordance with the present disclosure may enable one or more ports, gauges, and/or sensors to observe and measure properties of the wellbore and formation. For example, one or more ports may be used to receive fluid therein or dispatch fluid therefrom. During this process, one or more gauges, one or more sensors, and/or one or more other ports may be used to observe properties of the wellbore and the formation, such as increases and/or decreases of fluid flow in areas of the formation affected by the fluid moving through the ports of the tool. Accordingly, the present disclosure contemplates a tool that may have a variety of functions and uses without departing from the scope of the present disclosure.

Although the present invention has been described with respect to specific details, it is not intended that such details should be regarded as limitations on the scope of the invention, except to the extent that they are included in the accompanying claims.

What is claimed is:

1. A tool to be used within a wellbore, the wellbore including a wall and extending in a formation with formation fluid, comprising:

a packer expandable against the wellbore wall;

ports included within the packer to enable formation fluid to flow into the tool from the formation;

the ports being arranged in a first port configuration optimized based upon a first predetermined formation property; and a second port configuration, wherein:

the ports are switchable between the first port configuration and the second port configuration; and the second port configuration is optimized based upon a second predetermined formation property.

2. The tool of claim 1, wherein:

the ports comprise a first set of ports and a second set of ports;

in the first port configuration, the first set of ports are configured to enable formation fluid to flow into the tool from the formation and the second set of ports are configured to prevent formation fluid to flow into the tool from the formation; and in the second port configuration, the first set of ports are configured to prevent formation fluid to flow into the tool from the formation and the second set of ports are configured to enable formation fluid to flow into the tool from the formation.

3. The tool of claim 2, wherein:

the tool comprises an axis extending therethrough;

the first set of ports comprises a first circumferential position on the packer with respect to the axis; and the second set of ports comprises a second circumferential position on the packer with respect to the axis different from the first circumferential position.

4. The tool of claim 2, wherein:

the tool comprises an axis extending therethrough;

the first set of ports comprises a first axial position on the packer with respect to the axis; and the second set of ports comprises a second axial position on the packer with respect to the axis different from the first axial position.

5. The tool of claim 1, wherein the ports comprise a sample port to sample formation fluid from the formation and a guard port to guard the sample port from contamination.

6. The tool of claim 5, wherein the first port configuration is optimized by optimizing an axial distance between the sample port and the guard port.

7. The tool of claim 5, wherein the first port configuration is optimized by optimizing a ratio of an area of the sample port to an area of the guard port.

8. The tool of claim 5, wherein the first port configuration is optimized by optimizing a height of the guard port.

9. The tool of claim 5, wherein the first port configuration is optimized by optimizing a width of the guard port.

10. The tool of claim 1, wherein the first predetermined formation property is a ratio of permeability for the formation in a first direction to permeability for the formation in a second direction.

11. A method to collect fluid within a wellbore, the wellbore including a wall and extending in a formation with formation fluid, the method comprising:

selecting a first port configuration for ports positioned on a packer optimized based upon a first predetermined formation property;

expanding the packer against the wellbore wall;

receiving formation fluid from the formation into the tool through the ports;

selecting a second port configuration optimized based upon a second formation property; and switching between the first port configuration and the second portion configuration.

12. The method of claim 11, further comprising:

receiving formation fluid from the formation into the tool through a first set of ports and preventing formation fluid to flow from the formation into the tool through a second set of ports when in the first port configuration; and receiving formation fluid from the formation into the tool through the second set of ports and preventing formation fluid to flow from the formation into the tool through the first set of ports when in the second port configuration.

13. The method of claim 11, wherein switching between the first port configuration and the second portion configuration comprises:

switching between a first set of ports at a first circumferential position on the packer and a second set of ports at a second circumferential position on the packer; and switching between the first set of ports at a first axial position on the packer and the second set of ports at a second axial position on the packer.

14. The method of claim 11, wherein the ports comprise a sample port to sample formation fluid from the formation and a guard port to guard the sample port from contamination, wherein selecting the first port configuration for the ports comprises at least one of:

optimizing an axial distance between the sample port and the guard port;

optimizing a ratio of an area of the sample port to an area of the guard port;

optimizing a height of the guard port; and optimizing a width of the guard port.

15. The method of claim 11, wherein selecting the first port configuration for the ports comprises:

measuring permeability for the formation in a first direction;

measuring permeability for the formation in a second direction; and selecting the first port configuration for the ports optimized based upon a ratio of the permeability for the formation in the first direction to the permeability for the formation in the second direction.

16. A packer to be used within a wellbore, the wellbore including a wall and extending in a formation with formation fluid, the packer comprising:

ports comprising a sample port to sample formation fluid from the formation and a guard port to guard the sample port from contamination, the ports included within the packer to enable formation fluid to flow into the tool from the formation;

the ports being arranged in a first port configuration optimized based upon a first ratio of permeability for the formation in a first direction to permeability for the formation in a second direction; and a second port configuration, wherein:

the ports are switchable between the first port configuration and the second port configuration;

the second port configuration is optimized based upon a second ratio of the permeability for the formation in the first direction to the permeability for the formation in the second direction.

17. The packer of claim 16, wherein the first port configuration is optimized by optimizing one of:

an axial distance between the sample port and the guard port;

a ratio of an area of the sample port to an area of the guard port;

a height of the guard port; and a width of the guard port.

* * * * *